US010791833B2

(12) United States Patent
Chen et al.

(10) Patent No.: US 10,791,833 B2
(45) **Date of Patent: *Oct. 6, 2020**

(54) SLIDE RAIL ASSEMBLY

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shun-Ho Yang, Kaohsiung (TW); Zong-Sian Wong, Kaohsiung (TW); Chun-Chiang Wang, Kaohsiung (TW)

(73) Assignees: KING SLIDE WORKS CO., LTD., Kaohsiung (TW); KING SLIDE TECHNOLOGY CO., LTD., Kaohsiung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/299,162

(22) Filed: Mar. 12, 2019

(65) Prior Publication Data

US 2020/0163456 A1 May 28, 2020

(30) Foreign Application Priority Data

Nov. 23, 2018 (TW) ..... 107142150 A

(51) Int. Cl.
*A47B 88/443* (2017.01)
*A47B 88/45* (2017.01)

(52) U.S. Cl.
CPC ..... *A47B 88/443* (2017.01); *A47B 88/45* (2017.01)

(58) Field of Classification Search
CPC ..... A47B 88/443; A47B 88/45; A47B 88/447; A47B 88/44
(Continued)

(56) References Cited

U.S. PATENT DOCUMENTS 3,488,097 A * 1/1970 Fall ..... A47B 88/493 384/18
3,701,577 A * 10/1972 Fischer ..... A47B 88/493 312/334.12
(Continued)

FOREIGN PATENT DOCUMENTS

EP 0 421 275 A1 4/1991
EP 3 505 007 A1 7/2019
(Continued)

*Primary Examiner* — Janet M Wilkens
(74) *Attorney, Agent, or Firm* — Winston Hsu

(57) ABSTRACT

A slide rail assembly includes a first rail, a second rail, a mounting member, a third rail, a fourth rail and a synchronizing member. The first rail includes a disengaging feature. The third rail and the fourth rail are arranged on two side of the mounting member, and the synchronizing member is arranged on the mounting member. The third rail is movable relative to the first rail and the second rail is movable relative to the fourth rail. When the second rail is moved from a retracted position along a direction, the second rail and the mounting member are synchronously moved through the synchronizing member. When the second rail and the mounting member are moved to a predetermined position, the synchronizing member is driven by the disengaging member of the first rail to be no longer synchronously moved.

19 Claims, 12 Drawing Sheets

(58) Field of Classification Search
USPC ..... 312/331, 332, 333
See application file for complete search history.

(56) References Cited

U.S. PATENT DOCUMENTS

| | | | | | |
|---|---|---|---|---|---|
| 3,778,120 | A * | 12/1973 | Hagen | A47B 88/493 | 384/18 |
| 4,025,138 | A * | 5/1977 | Kittle | A47B 88/493 | 384/18 |
| 4,067,632 | A * | 1/1978 | Sekerich | A47B 88/493 | 312/334.9 |
| 4,285,560 | A * | 8/1981 | Miller | A47B 88/493 | 108/83 |
| 4,662,761 | A * | 5/1987 | Hoffman | A47B 88/493 | 384/18 |
| 4,737,039 | A * | 4/1988 | Sekerich | A47B 88/493 | 384/18 |
| 4,988,214 | A * | 1/1991 | Clement | A47B 88/493 | 312/333 |
| 4,993,847 | A * | 2/1991 | Hobbs | A47B 88/57 | 312/334.46 |
| 4,998,828 | A * | 3/1991 | Hobbs | A47B 88/493 | 312/334.46 |
| 6,244,679 | B1 * | 6/2001 | Robertson | A47B 88/493 | 29/505 |
| 7,413,269 | B2 | 8/2008 | Chen | | |
| 10,499,738 | B2 * | 12/2019 | Chen | F16C 29/04 | |
| 10,674,821 | B2 * | 6/2020 | Chen | A47B 88/45 | |
| 10,729,241 | B2 * | 8/2020 | Chen | A47B 88/493 | |
| 2004/0174100 | A1 * | 9/2004 | Chen | A47B 88/487 | 312/333 |
| 2005/0162052 | A1 * | 7/2005 | Chen | A47B 88/487 | 312/334.5 |
| 2018/0087572 | A1 * | 3/2018 | Chen | A47B 88/497 | |

FOREIGN PATENT DOCUMENTS

| | | | |
|---|---|---|---|
| EP | 3505008 | * | 7/2019 |
| JP | 2018-47220 A | | 3/2018 |
| WO | 88/01144 | * | 2/1988 |
| WO | 88/01144 A1 | | 2/1988 |

* cited by examiner

SLIDE RAIL ASSEMBLY

BACKGROUND OF THE INVENTION

1. Field of the Invention

The present invention relates to a slide rail assembly, and more particularly, to a slide rail including two or more-section slide rail

2. Description of the Prior Art

In general, the left and right sides of a rack or a cabinet with a predetermined height would be arranged with a plurality of sets of slide rail assembly from top to bottom. Each slide rail assembly is configured to carry a carried object (such as an electronic apparatus) or a drawer, such that the carried object or drawer is able to be pulled out from inside of the rack or cabinet to be extended through the slide rail assembly, or is able to be pushed in from outside of the rack or cabinet to be retracted in the rack or cabinet.

However, due to some spatial requirements between the slide rail assembly and the rack (or cabinet), a product which differs from an existing two or three-section slide rail assembly is developed to meet this specific demand.

SUMMARY OF THE INVENTION

The present invention provides a slide rail assembly capable of mounting a plurality of slide rails on a mounting member to form a two or more-section slide rail assembly.

According to an aspect of the present invention, a slide rail assembly includes a first rail, a second rail, a mounting member, a third rail, a fourth rail and a synchronizing member. The first rail includes a disengaging feature. Wherein, an abutting feature is arranged on the second rail. The third rail and the fourth rail are respectively connected to a first side of the mounting member and a second side of the mounting member. The synchronizing member is arranged on the mounting member. Wherein, the third rail is longitudinally movable relative to the first rail, and the second rail is longitudinally movable relative to the fourth rail. Wherein, when the second rail is moved from a retracted position along an extending direction, the abutting feature of the second rail abuts against the synchronizing member, such that the mounting member and the second rail are synchronously moved, when the mounting member and the second rail are synchronously moved to a predetermined position, the synchronizing member is driven by the disengaging feature of the first rail to be disengaged from the abutting feature, such that the second rail and the mounting member are no longer synchronously moved.

Preferably, the synchronizing member is pivoted to the mounting member by a shaft member, the synchronizing member has a first contact portion and a second contact portion, the first contact portion is configured to cooperate with the abutting feature of the second rail, the second contact portion is configured to cooperate with the disengaging feature of the first rail.

Preferably, the mounting member includes a first opening corresponding to the first rail, the second contact portion of the synchronizing member passes through the first opening.

Preferably, the slide rail assembly further includes a first elastic member configured to provide an elastic force to the synchronizing member.

Preferably, the first rail further includes an engaging feature, the slide rail assembly further includes a positioning member able to be located at a disengaging position or an engaging position relative to the mounting member, when the mounting member and the second rail are no longer synchronously moved, the mounting member is engaged with the engaging feature of the first rail through the positioning member being moved from the disengaging position to the engaging position.

Preferably, the positioning member is movably mounted on the mounting member, the mounting member has a second opening corresponding to the first rail, a part of the positioning member passes through the second opening to be engaged with the engaging feature of the first rail.

Preferably, the slide rail assembly further includes a second elastic member configured to provide an elastic force to the positioning member.

Preferably, the first rail and the second rail are respectively oriented parallel to upper and lower parts of the mounting member.

Preferably, the mounting member includes a first portion and a second portion, the fourth rail is fixedly connected to the first portion, and the third rail is fixedly connected to the second portion.

Preferably, the mounting member further includes a third portion, the first portion and the second portion are substantially perpendicular to the third portion and extended along different directions.

Preferably, the first side and the second side of the mounting member are two opposite sides.

Preferably, the first rail includes a first wall, a second wall and a side wall connected between the first wall and the second wall of the first rail, a first passage is defined by the first wall, the second wall and the side wall of the first rail, the third rail is movable relative to the first rail through the first passage.

Preferably, the third rail includes a first wall, a second wall and a side wall connected between the first wall and the second wall of the third rail, the side wall of the third rail is connected to the second portion of the mounting member, the first and second walls of the third rail are located in the first passage.

Preferably, the slide rail assembly further includes a first sliding auxiliary device movably mounted between the first rail and the third rail, wherein the first sliding auxiliary device includes a plurality of sliding auxiliary members configured to support the first wall of the first rail and the first wall of the third rail and configured to support the second wall of the first rail and the second wall of the third rail.

Preferably, the first wall of the first rail has a first section and a second section bent relative to the first section, and the second wall of the first rail has a third section and a fourth section bent relative to the third section.

Preferably, the fourth rail includes a first wall, a second wall and a side wall connected between the first wall and the second wall of the fourth rail, the side wall of the fourth rail is connected to the first portion of the mounting member, a second passage is defined by the first wall, the second wall and the side wall of the fourth rail, the second rail is movable relative to the fourth rail through the second passage.

Preferably, the second rail includes a first wall, a second wall and a side wall connected between the first wall and the second wall of the second rail, the first and second walls of the second rail are located in the second passage.

Preferably, the slide rail assembly further includes a second sliding auxiliary device movably mounted between the fourth rail and the second rail, wherein the second sliding auxiliary device includes a plurality of sliding auxiliary members configured to support the first wall of the fourth rail and the first wall of the second rail and configured to support the second wall of the fourth rail and the second wall of the second rail.

Preferably, the fourth rail includes a front portion and a blocking base located adjacent to the front portion, and a first blocking member and a second blocking member are both movably mounted on the second rail, when the second rail is moved relative to the fourth rail along the extending direction to an open position, the first blocking member and the second blocking member are located at two sides of the blocking base at a blocking position, such that the first blocking member and the second blocking member are blocked by the blocking portion of the blocking base, in order to prevent the second rail from being moved along the extending direction or a retracting direction.

Preferably, when the first blocking member is not located at the blocking position, the second rail is movable from the open position along the retracting direction, when the second rail is moved to a predetermined retracted position, the positioning member is driven by the second rail to move from the engaging position, such that the positioning member is no longer engaged with the engaging feature of the first rail.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
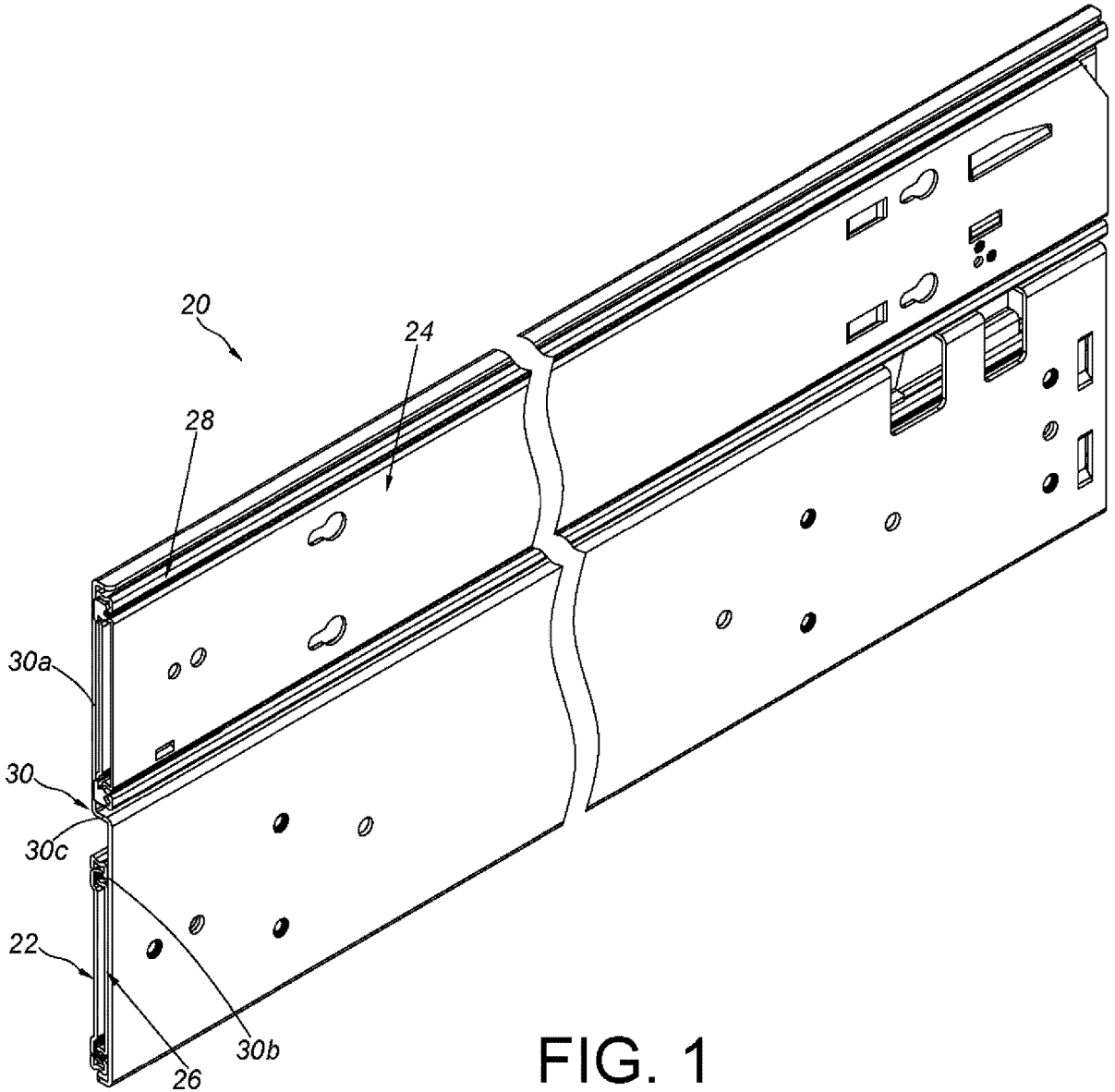
FIG. 1 is a schematic diagram illustrating a slide rail assembly according to an embodiment of the present invention.
Figure 2:
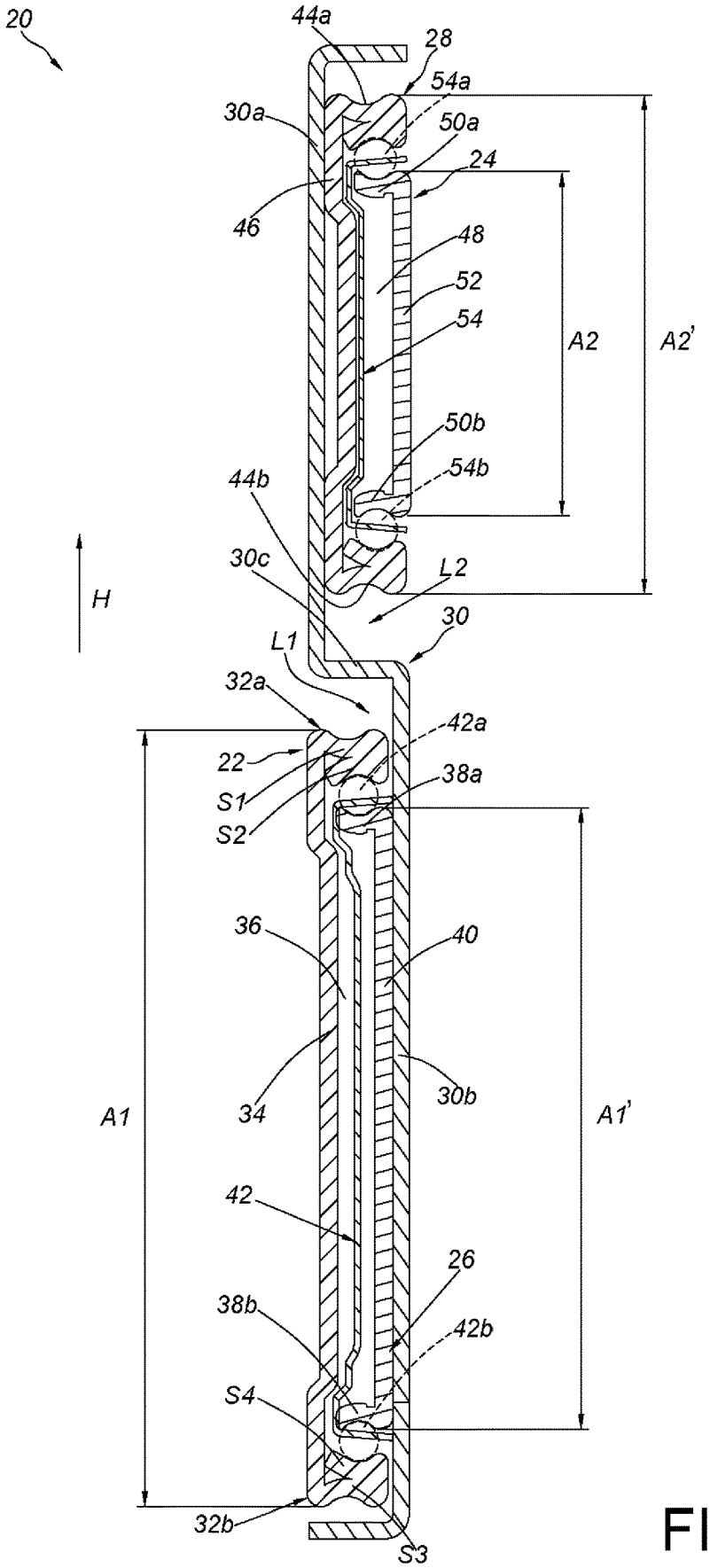
FIG. 2 is a cross-sectional view illustrating a slide rail assembly according to the embodiment of the present invention.

As shown in FIG. 1 and FIG. 2, a slide rail assembly 20 according to an embodiment of the present invention includes a first rail 22, a second rail 24, a third rail 26 a fourth rail 28 and a mounting member 30.

Preferably, the first rail 22 and the second rail 24 are respectively oriented parallel to upper and lower parts of the mounting member 30. According to the above arrangement, there is a height difference between the second rail 24 and the first rail 22. Preferably, the mounting member 30 comprises a first portion 30*a* and a second portion 30*b*, the fourth rail 28 and the third rail 26 are respectively connected to the first portion 30*a* and the second portion 30*b* of the mounting member 30. Wherein, the third rail 26 is movable relative to the first rail 22, and the second rail 24 is movable relative to the fourth rail 28. Preferably, the mounting member 30 further comprises a third portion 30*c*, and the first portion 30*a* and the second portion 30*b* are substantially perpendicular to and connected to the third portion 30*c*, and are extended along different directions. For example, the first portion 30*a* extends upward by a predetermined length relative to the third portion 30*c*, and the second portion 30*b* extends downward relative to the third portion 30*c*. Therefore, the first portion 30*a* is arranged as an upper portion, and the second portion 30*b* is arranged as a lower portion.

Preferably, the first rail 22 comprises a first wall 32*a*, a second wall 32*b* and a side wall 34 connected between the first wall 32*a* and the second wall 32*b* of the first rail 22, a first passage 36 is defined by the first wall 32*a*, the second wall 32*b* and the side wall 34 of the first rail 22.

The third rail 26 is connected to the second portion 30*b* of the mounting member 30 and located on a first side L1 of the mounting member 30. The third rail 26 is movable relative to the first rail 22 through the first passage 36. Wherein, the third rail 26 comprises a first wall 38*a*, a second wall 38*b* and a side wall 40 connected between the first wall 38*a* and the second wall 38*b* of the third rail 26, the side wall 40 of the third rail 26 is fixedly connected to the second portion 30*b* of the mounting member 30, the first wall 38*a* and the second wall 38*b* of the third rail 26 are located in the first passage 36 of the first rail 22. In addition, the side wall 34 of the first rail 22 has a dimension A1 along a height direction H of the slide rail assembly 20. The side wall 40 of the third rail 26 has a dimension A1' along the height direction H of the slide rail assembly 20. The dimension A1 is greater than the dimension A1' (please refer to FIG. 2). Therefore, when the first rail 22 and the third rail 26 of the slide rail assembly 20 are in a retraced state relative to the mounting member 30, the third rail 26 is able to be retracted into the first passage 36 of the first rail 22, and the side wall 34 of the first rail 22 is able to cover the third rail 26. Preferably, the slide rail assembly 20 further comprises a first sliding auxiliary device 42 movably mounted between the first rail 22 and the third rail 26. The first sliding auxiliary device 42 comprises a plurality of sliding auxiliary members (e.g. a first sliding auxiliary member 42*a* and a second sliding auxiliary member 42*b*). The first sliding auxiliary member 42*a* and the second sliding auxiliary member 42*b* are balls or rollers and the like. The first sliding auxiliary member 42*a* is configured to support the first wall 32*a* of the first rail 22 and the first wall 38*a* of the third rail 26. The second sliding auxiliary member 42*b* is configured to support the second wall 32*b* of the first rail 22 and the second wall 38*b* of the third rail 26. Preferably, the first wall 32*a* of the first rail 22 has a first section S1 and a second section S2 bent relative to the first section S1. The second wall 32*b* of the first rail 22 has a third section S3 and a fourth section S4 bent relative to the third section S3. According to the above arrangement, the supporting structure of the first rail 22 is improved. Wherein, the second section S2 of the first wall 32*a* of the first rail 22 is bent relative to the first section S1 toward the side wall 34 of the first rail 22, and the fourth section S4 of the second wall 32*b* of the first rail 22 is bent relative to the third section S3 toward the side wall 34 of the first rail 22. In other words, the second section S2 and the fourth section S4 of the first rail 22 are bent inward relative to the side wall 34 of the first rail 22. In addition, the second section S2 of the first wall 32*a* of the first rail 22 and/or the fourth section S4 of the second wall 32*b* of the first rail 22 of the present invention is an omissible component. In other words, a first wall of a first rail of another embodiment of the present invention can only comprise a first section, and a second wall of the first rail can only comprise a third section. The first section and the third section can be respectively extended from two opposite ends of the side wall.

The fourth rail 28 is connected to the first portion 30*a* of the mounting member 30 and located at a second side L2 of the mounting member 30. The first side L1 and the second side L2 are opposite sides. The fourth rail 28 comprises a first wall 44*a*, a second wall 44*b* and a side wall 46 connected between the first wall 44*a* and the second wall 44*b* of the fourth rail 28. The side wall 46 of the fourth rail 28 is fixedly connected to the first portion 30*a* of the mounting member 30, a second passage 48 is defined by the first wall 44*a*, the second wall 44*b* and the side wall 46 of the fourth rail 28, the second rail 24 is movable relative to the fourth rail 28 through the second passage 48.

The second rail 24 comprises a first wall 50*a*, a second wall 50*b* and a side wall 52 connected between the first wall 50*a* and the second wall 50*b* of the second rail 24, the first wall 50*a* and the second wall 50*b* of the second rail 24 are located in the second passage 48 of the fourth rail 28. In addition, the side wall 52 of the second rail 24 has a dimension A2 along the height direction H of the slide rail assembly 20. The side wall 46 of the fourth rail 28 has a dimension A2' along the height direction H of the slide rail assembly 20. The dimension A2 is less than the dimension A2' (please refer to FIG. 2). Therefore, when the second rail 24 and the fourth rail 28 of the slide rail assembly 20 are in a retraced state relative to the mounting member 30, the second rail 24 is able to be retracted into the second passage 48 of the fourth rail 28, and a closed space is defined by the first wall 50*a*, the second wall 50*b* and the side wall 52 of the second rail 24 and the side wall 46 of the fourth rail 28. Preferably, the slide rail assembly 20 further comprises a second sliding auxiliary device 54 movably mounted between the fourth rail 28 and the second rail 24. The second sliding auxiliary device 54 comprises a plurality of sliding auxiliary members (e.g. a first sliding auxiliary member 54*a* and a second sliding auxiliary member 54*b*). The first sliding auxiliary member 54*a* and the second sliding auxiliary member 54*b* are balls or rollers and the like. The first sliding auxiliary member 54*a* is configured to support the first wall 50*a* of the second rail 24 and the first wall 44*a* of the fourth rail 28. The second sliding auxiliary member 54*b* is configured to support the second wall 50*b* of the second rail 24 and the second wall 44*b* of the fourth rail 28.

Figures 3, 4:
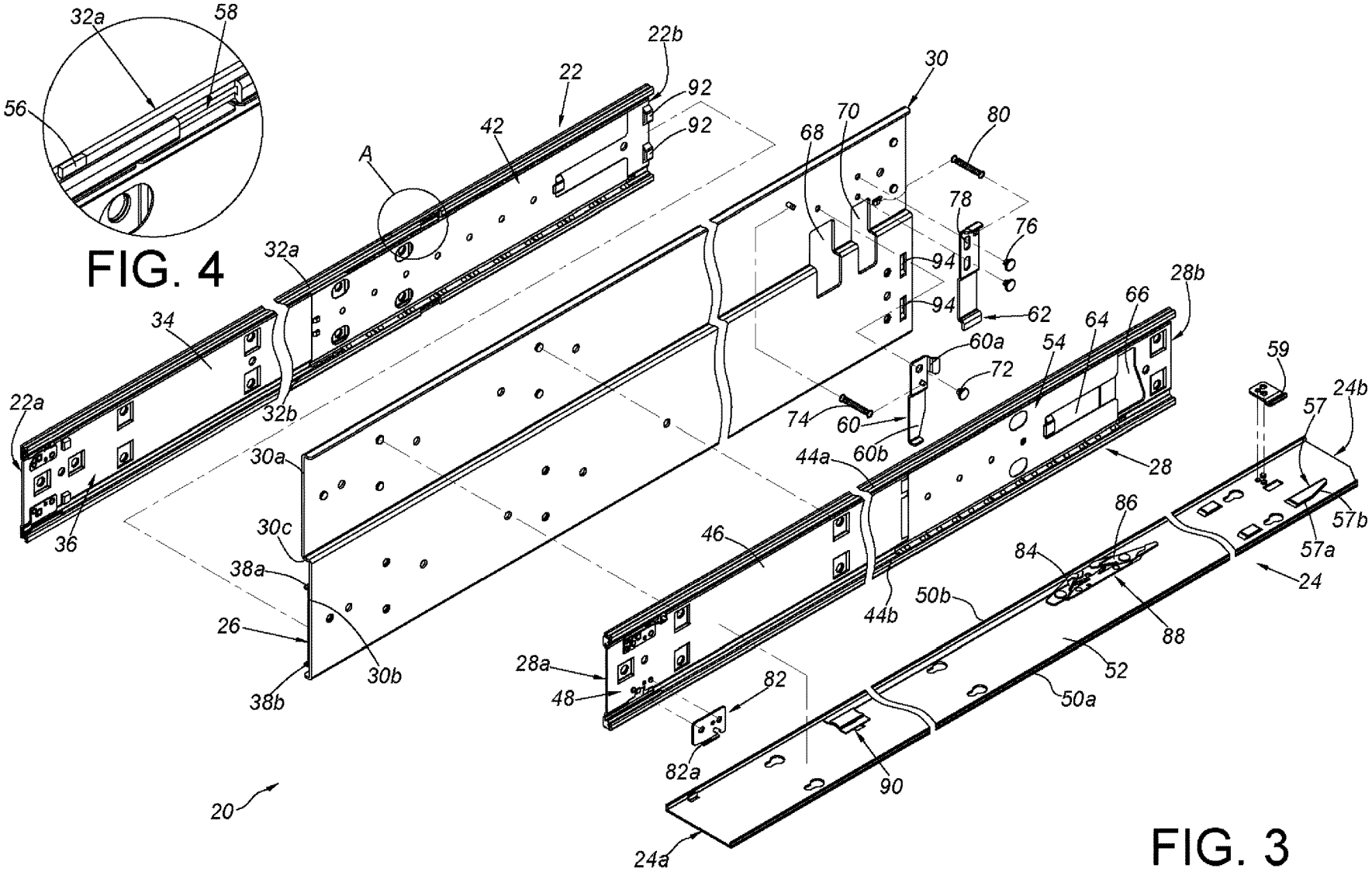
FIG. 3 is an exploded view illustrating the slide rail assembly according to the embodiment of the present invention.
FIG. 4 is an enlarged view of an area A of FIG. 3.
Figure 5:
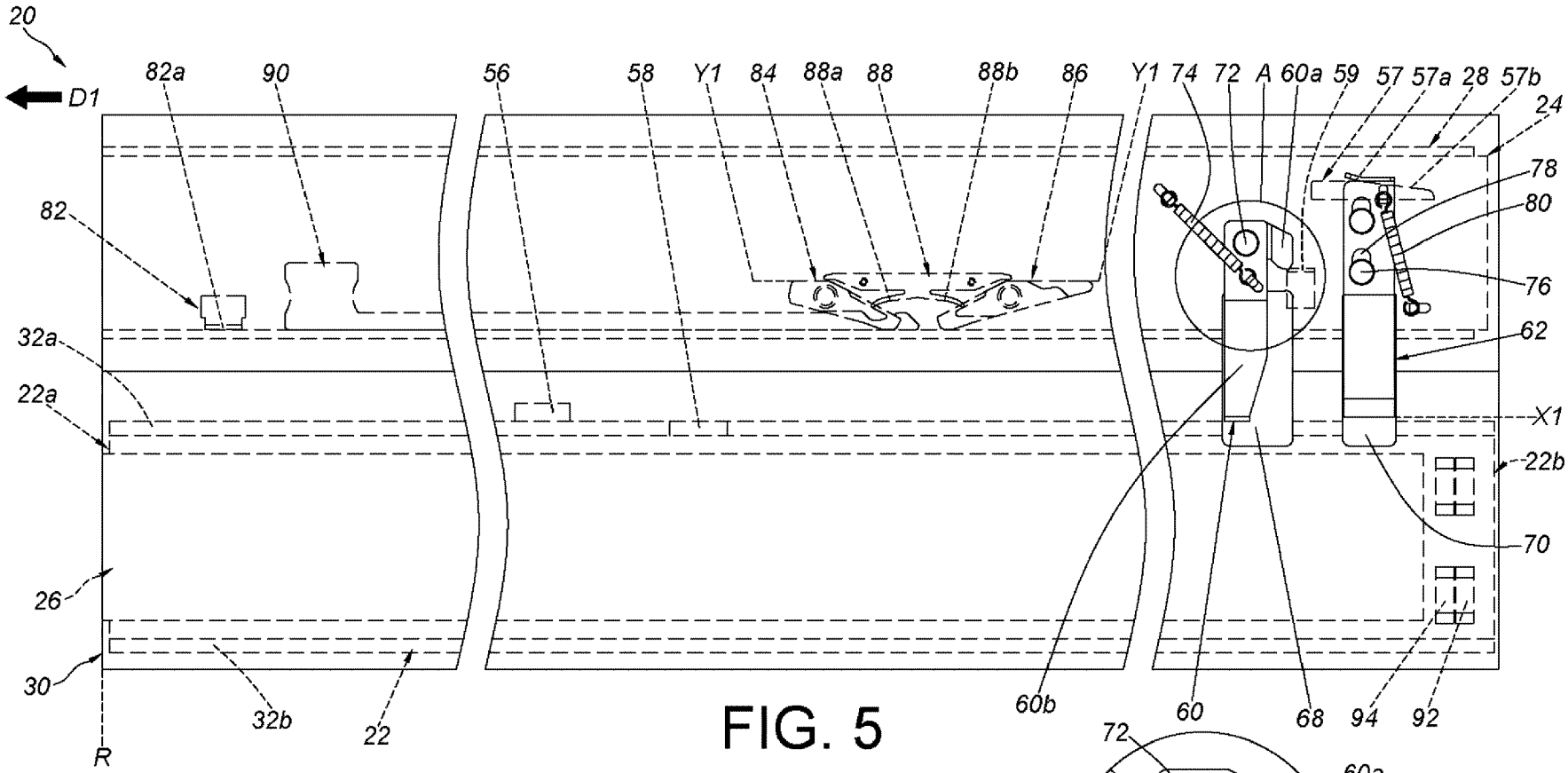
FIG. 5 is a diagram illustrating the slide rail assembly being in a retracted state according to the embodiment of the present invention.

As shown in FIG. 3 and FIG. 5, the third rail 26 and the fourth rail 28 are fixedly respectively connected to the second portion 30*b* and the first portion 30*a* of the mounting member 30 to be located at two different sides of the mounting member 30. The mounting member 30, the third rail 26 and the fourth rail 28 are able to be regarded as a one-piece member. Wherein, the third rail 26 and the first rail 22 are able to be mounted on each other through the first passage 36, and the third rail 26 is longitudinally movable relative to the first rail 22. On the other hand, the second rail 24 and the fourth rail 28 are able to be mounted on each other through the second passage 48, and the second rail 24 is longitudinally movable relative to the fourth rail 28.

Moreover, the first rail 22 has a front portion 22*a* and a rear portion 22*b*. The first rail 22 comprises a disengaging feature 56 and an engaging feature 58 (please refer to FIG. 4). Preferably, the disengaging feature 56 is located at the first wall 32*a* of the first rail 22. In the present embodiment, the disengaging feature 56 is a protrusion, but the present invention is not limited thereto. Preferably, the engaging feature 58 is located at the first wall 32*a* of the first rail 22, and a distance is form between the disengaging feature 56 and the engaging feature 58. In the present embodiment, the engaging feature 58 is a space (such as a slot or a concave structure) defined by two corresponding walls.

An abutting feature 59 is arranged on the second rail 24. In the present embodiment, the abutting feature 59 is a protrusion, but the present invention is not limited thereto. The abutting feature 59 can be formed on the second rail 24, or can be an external component mounted on the second rail 24. Preferably, a function portion 57 is arranged on the second rail 24. In the present embodiment, the function portion 57 is a protrusion, and comprises an abutting section 57*a* and a guiding section 57*b* extended from the abutting section 57*a*. Wherein, the guiding section 57*b* has an inclined surface or an arc surface.

The slide rail assembly 20 comprises a synchronizing member 60. Preferably, the slide rail assembly 20 further comprises a positioning member 62. The synchronizing member 60 and the positioning member 62 are arranged on the mounting member 30. For example, the synchronizing member 60 and the positioning member 62 are arranged on the second side L2 of the first portion 30*a* of the mounting member 30. Preferably, the side wall 46 of the fourth rail 28 comprises a first corresponding through hole 64 and a second corresponding through hole 66. The first corresponding through hole 64 and the second corresponding through hole 66 are respectively located corresponding to the synchronizing member 60 and the positioning member 62. Preferably, a first opening 68 and a second opening 70 are formed on the mounting member 30 corresponding to the first rail 22 (such as corresponding to the first wall 32*a* of the first rail 22). The first opening 68 and the second opening 70 are respectively located corresponding to the synchronizing member 60 and the positioning member 62.

The synchronizing member 60 is pivoted to the mounting member 30 by a shaft member 72. The synchronizing member 60 has a first contact portion 60*a* and a second contact portion 60*b*. The first contact portion 60*a* is configured to cooperate with the abutting feature 59 of the second rail 24. For example, the first contact portion 60*a* and the abutting feature 59 of the second rail 24 can be cooperated by contacting each other. The second contact portion 60*b* passes through the first opening 68, and is configured to cooperate with the disengaging feature 56 of the first wall 32*a* of the first rail 22. For example, the second contact portion 60*b* and the first wall 32*a* of the first rail 22 can be cooperated by contacting each other. Preferably, the slide rail assembly 20 further comprises a first elastic member 74 configured to provide an elastic force to the synchronizing member 60.

The positioning member 62 is movably mounted on the mounting member 30. For example, one of the positioning member 62 and the mounting member 30 has a first guiding feature 76, and the other one of the positioning member 62 and the mounting member 30 has a second guiding feature 78. The first guiding feature 76 and the second guiding feature 78 are a combination of a protrusion and a long hole (or a long slot) corresponding to each other. Wherein, part of the protrusion passes through the long hole. Preferably, the positioning member 62 corresponds to the engaging feature 58 of the first wall 32*a* of the first rail 22 through the second opening 70. Preferably, the slide rail assembly 20 further comprises a second elastic member 80 configured to provide an elastic force to the positioning member 62.

The second rail 24 has a front portion 24*a* and a rear portion 24*b*. On the other hand, the fourth rail 28 has a front portion 28*a* and a rear portion 28*b*. Preferably, a blocking base 82 is arranged adjacent to the front portion 28*a* of the fourth rail 28. Moreover, a first blocking member 84 and a second blocking member 86 are both movably mounted (e.g. be pivoted) on the second rail 24. Preferably, the second rail 24 further comprises an elastic base 88 having a first elastic portion 88*a* and a second elastic portion 88*b* to respectively provide elastic force to the first blocking member 84 and the second blocking member 86, such that the first blocking member 84 and the second blocking member 86 are hold in a predetermined state. Preferably, the second rail 24 further comprises an operating member 90 to be operated to drive the first blocking member 84 to be no longer in the predetermined state.

As shown in FIG. 5, the slide rail assembly 20 is in a retracted state. Preferably, at least one blocking structure 92 is arranged adjacent to the rear portion 22*b* of the first rail 22. In the present embodiment, the at least one blocking structure 92 is a protrusion, but the present invention is not limited thereto. The at least one blocking structure 92 is configured to block at least one corresponding structure 94 arranged in rear portion of the mounting member 30, to prevent the mounting member 30 from being moved backward relative to the first rail 22. Moreover, the second rail 24 is able to abut against the first contact portion 60*a* of the synchronizing member 60 through the abutting feature 59 (please refer to FIG. 6). Preferably, when the second rail 24 is located at a retracted position R, the abutting section 57*a* of the function portion 57 of the second rail 24 is able to abut against the positioning member 62, such that the positioning member 62 is located at a disengaged position X1 and the second elastic member 80 accumulates the elastic force. In addition, when the second rail 24 is located at the retracted position R relative to the fourth rail 28, a distance is formed between the blocking base 82 and the first blocking member 84 (or the second blocking member 86). Wherein, the first blocking member 84 and the second blocking member 86 are in the predetermined state (such as be located at a blocking position Y1).

Figure 6:
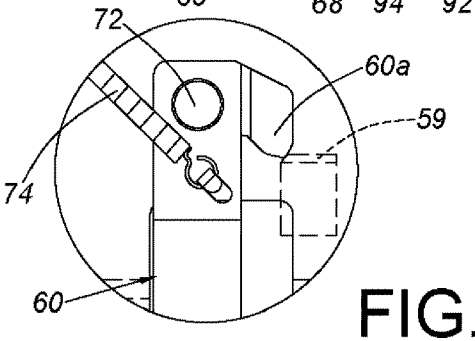
FIG. 6 is an enlarged view of an area A of FIG. 5.
Figure 7:
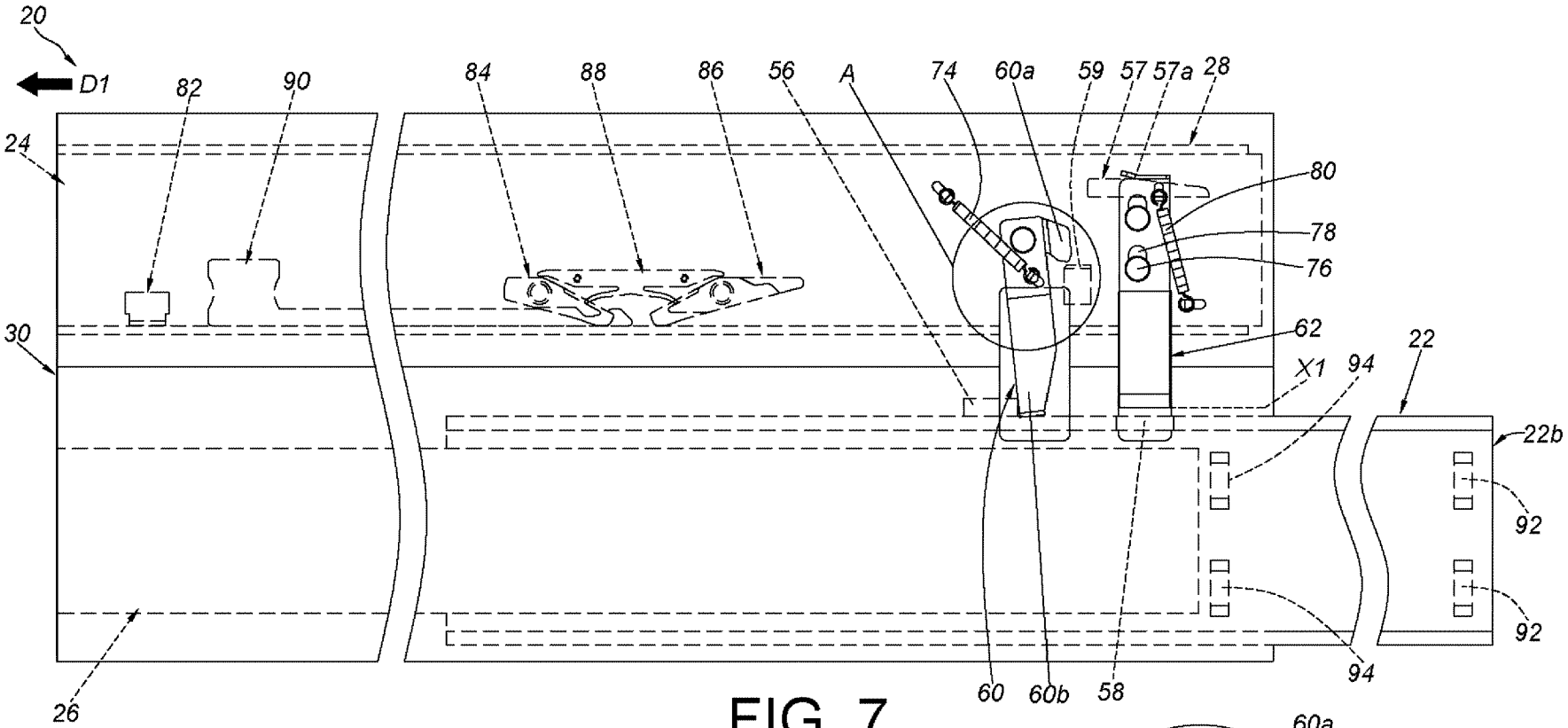
FIG. 7 is a diagram illustrating a second rail and a mounting member of the slide rail assembly being moved relative to a first rail along an extending direction according to the embodiment of the present invention.
Figure 8:
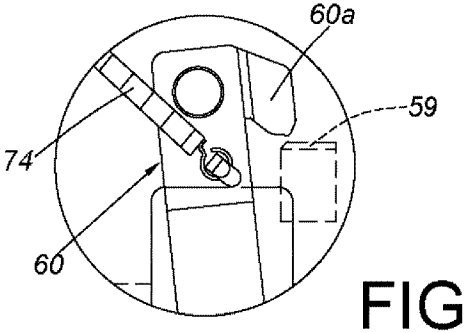
FIG. 8 is an enlarged view of an area A of FIG. 7.

As shown in FIG. 5 to FIG. 8, when the second rail 24 is moved forward (such as along an extending direction D1) from the retracted position R, the second rail 24 abuts against the first contact portion 60*a* of the synchronizing member 60 through the abutting feature 59 (as shown in FIG. 5 or FIG. 6), such that the mounting member 30 and the second rail 24 are synchronously moved. When the mounting member 30 and the second rail 24 are synchronously moved to a predetermined position, the synchronizing member 60 is driven by the disengaging feature 56 of the first rail 22 to be deflected by an angle to be disengaged from the abutting feature 59 (as shown in FIG. 7 or FIG. 8), such that the second rail 24 and the mounting member 30 are no longer synchronously moved. Wherein, when the synchronizing member 60 is deflected by the angle, the first elastic member 74 accumulates the elastic force. On the other hand, the positioning member 62 is located at the disengaged position X1 and not engaged with the engaging feature 58 of the first rail 22 (as shown in FIG. 7).

Figure 9:
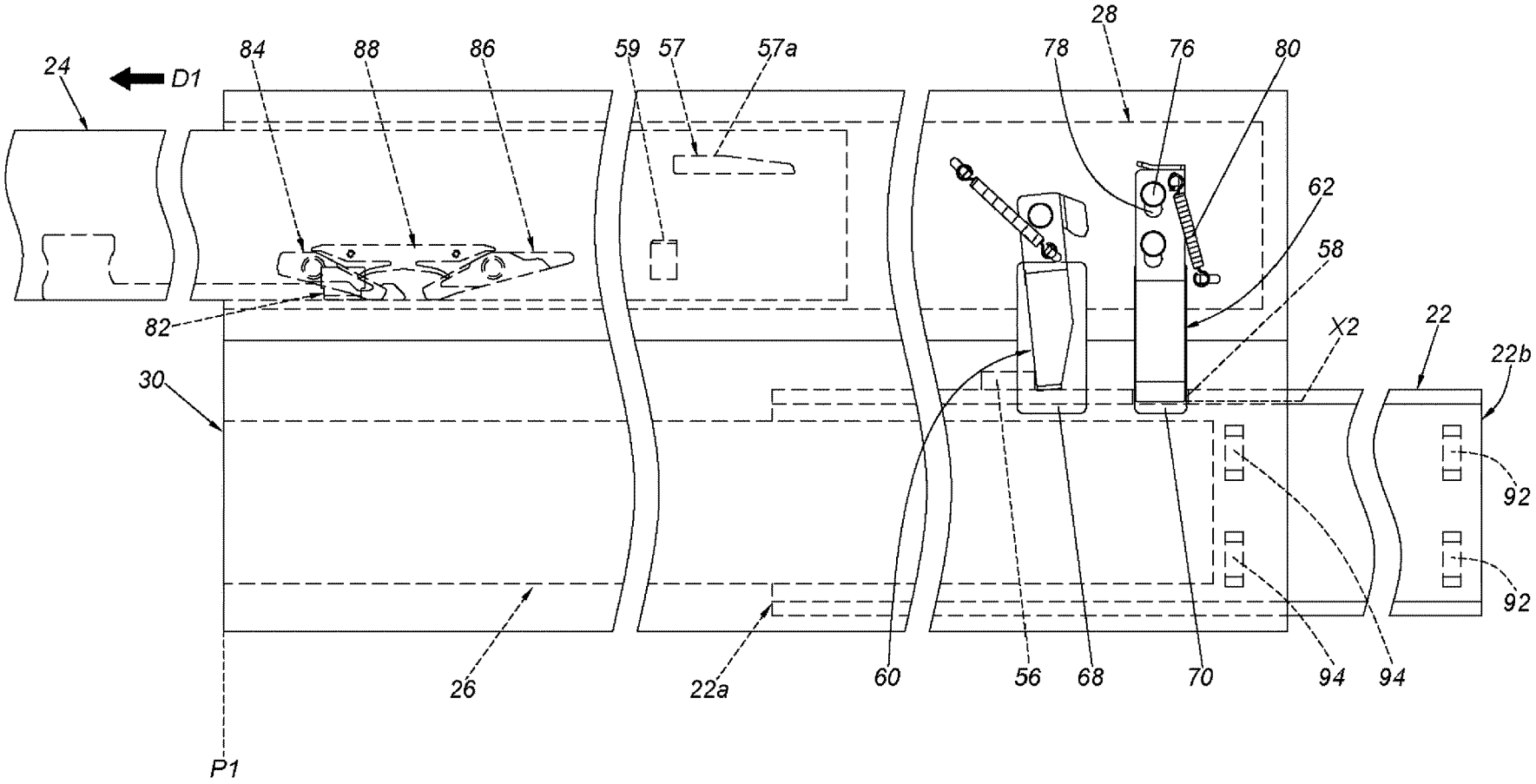
FIG. 9 is a diagram illustrating the mounting member of the slide rail assembly located at an extended position relative to the first rail, and the second rail being moved relative to the mounting member along the extending direction according to the embodiment of the present invention.

As shown in FIG. 9, when the mounting member 30 and the second rail 24 are no longer synchronously moved, the mounting member 30 is able to be moved from the disengaged position X1 to an engaged position X2 through the positioning member 62 to be engaged with the engaging feature 58 of the first rail 22, such that the mounting member 30 (and the third rail 26 and the fourth rail 28) is able to be hold to be located at an extended position P1 relative to the first rail 22. At this time, front portion of the mounting member 30 extends beyond the front portion 22*a* of the first rail 22. Specifically, when the second rail 24 is moved relative to the mounting member 30 along the extending direction D1, the abutting section 57*a* of the function portion 57 of the second rail 24 no longer abuts against the positioning member 62, such that the positioning member 62 is moved from the disengaged position X1 to the engaged position X2 in response to the elastic force of the second elastic member 80, such that the positioning member 62 is able to be engaged with the engaging feature 58 of the first rail 22.

Figure 10:
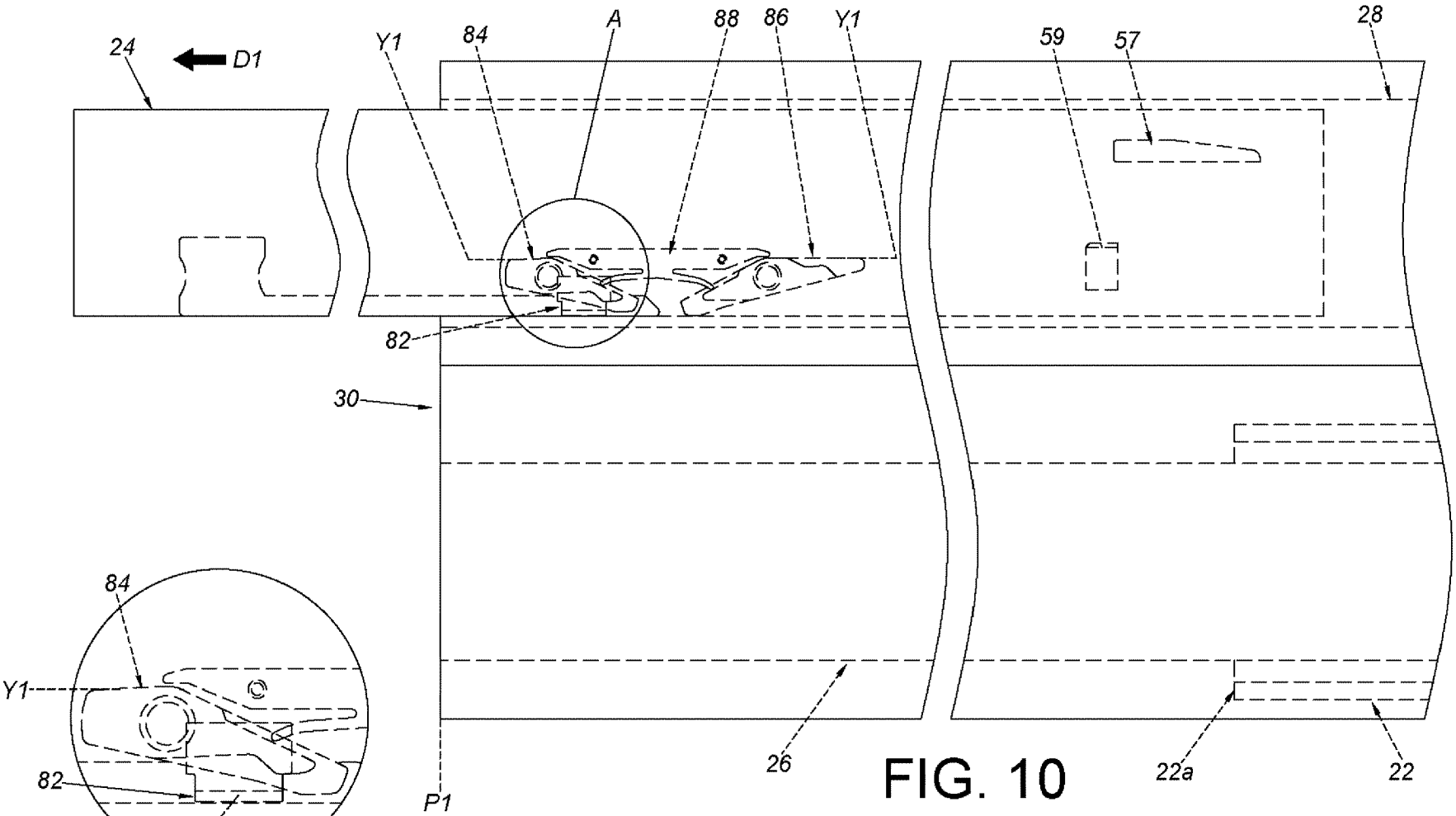
FIG. 10 is a diagram illustrating the mounting member of the slide rail assembly located at the extended position relative to the first rail, and the second rail being further moved relative to the mounting member along the extending direction according to the embodiment of the present invention.
Figure 11:
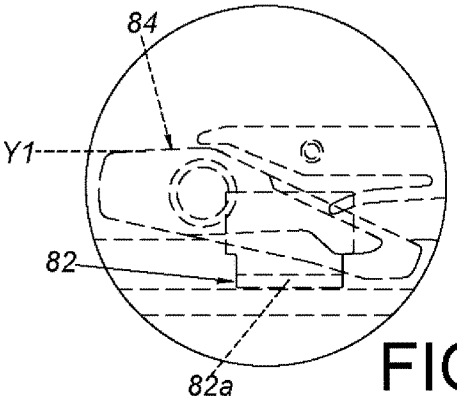
FIG. 11 is an enlarged view of an area A of FIG. 10.

As shown in FIG. 10 and FIG. 11, the mounting member 30 (and the third rail 26 and the fourth rail 28) is located at the extended position P1. In this status, when the second rail 24 is moved relative to the fourth rail 28 along the extending direction D1, the first blocking member 84 contacts a blocking portion 82*a* of the blocking base 82 of the fourth rail 28 (as shown in FIG. 11).

Figure 12:
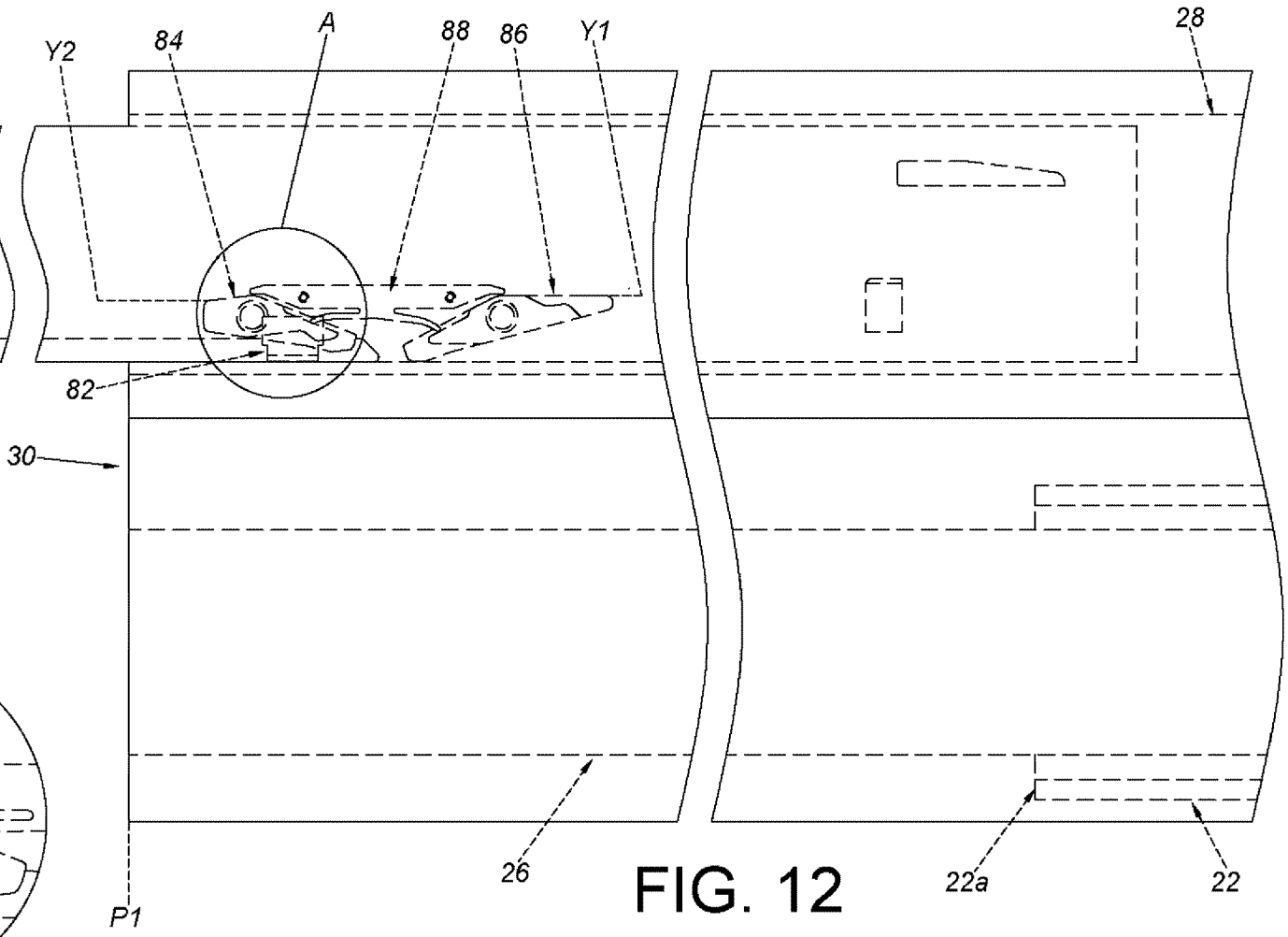
FIG. 12 is a diagram illustrating the mounting member of the slide rail assembly located at the extended position relative to the first rail, and the second rail being yet further moved relative to the mounting member along the extending direction according to the embodiment of the present invention.
Figure 13:
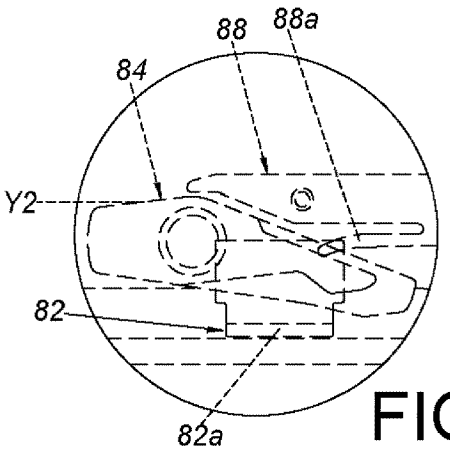
FIG. 13 is an enlarged view of an area A of FIG. 12.

As shown in FIG. 12 and FIG. 13, when the second rail 24 is moved relative to the fourth rail 28 along the extending direction D1, the first blocking member 84 abuts against the blocking portion 82*a* of the blocking base 82 and be driven to be deflected by an angle from the blocking position Y1 to an unblocking position Y2, such that the first blocking member 84 is able to pass through the blocking portion 82*a* of the blocking base 82. The first elastic portion 88*a* of the elastic base 88 accumulates an elastic force (as shown in FIG. 13).

Figure 14:
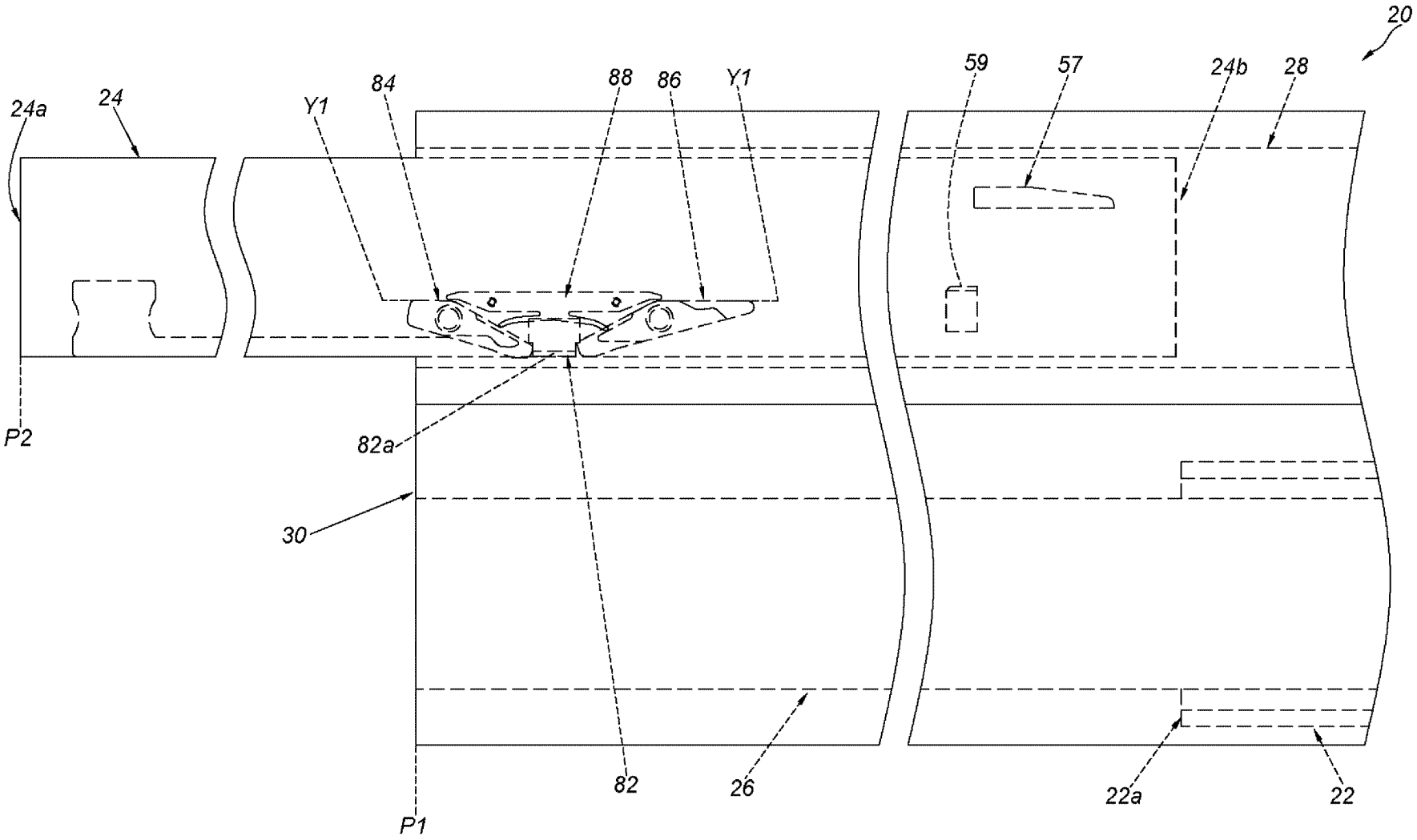
FIG. 14 is a diagram illustrating the mounting member of the slide rail assembly located at the extended position relative to the first rail, and the second rail being located at an open position relative to the mounting member according to the embodiment of the present invention.

As shown in FIG. 14, when the second rail 24 is further moved relative to the fourth rail 28 along the extending direction D1 to an open position P2, the first blocking member 84 has passed through the blocking portion 82*a* of the blocking base 82 and the first blocking member 84 is able to be located at the blocking position Y1 again in response to the elastic force released from the first elastic portion 88*a* of the elastic base 88. At this time, the first blocking member 84 and the second blocking member 86 are located at two sides of the blocking portion 82*a* of the blocking base 82 at the blocking position Y1, such that the first blocking member 84 and the second blocking member 86 are blocked by the blocking portion 82*a*, in order to prevent the second rail 24 from being moved along the extending direction D1 or along a retracting direction relative to the fourth rail 28. In this status, the slide rail assembly 20 is fully extended. Preferably, the operating member 90 is able to be operated to drive the first blocking member 84 to move from the blocking position Y1 to the unblocking position Y2 (please refer to FIG. 13), such that the second rail 24 is able to be moved relative to the fourth rail 28 from the open position P2 along the retracting direction.

Figure 15:
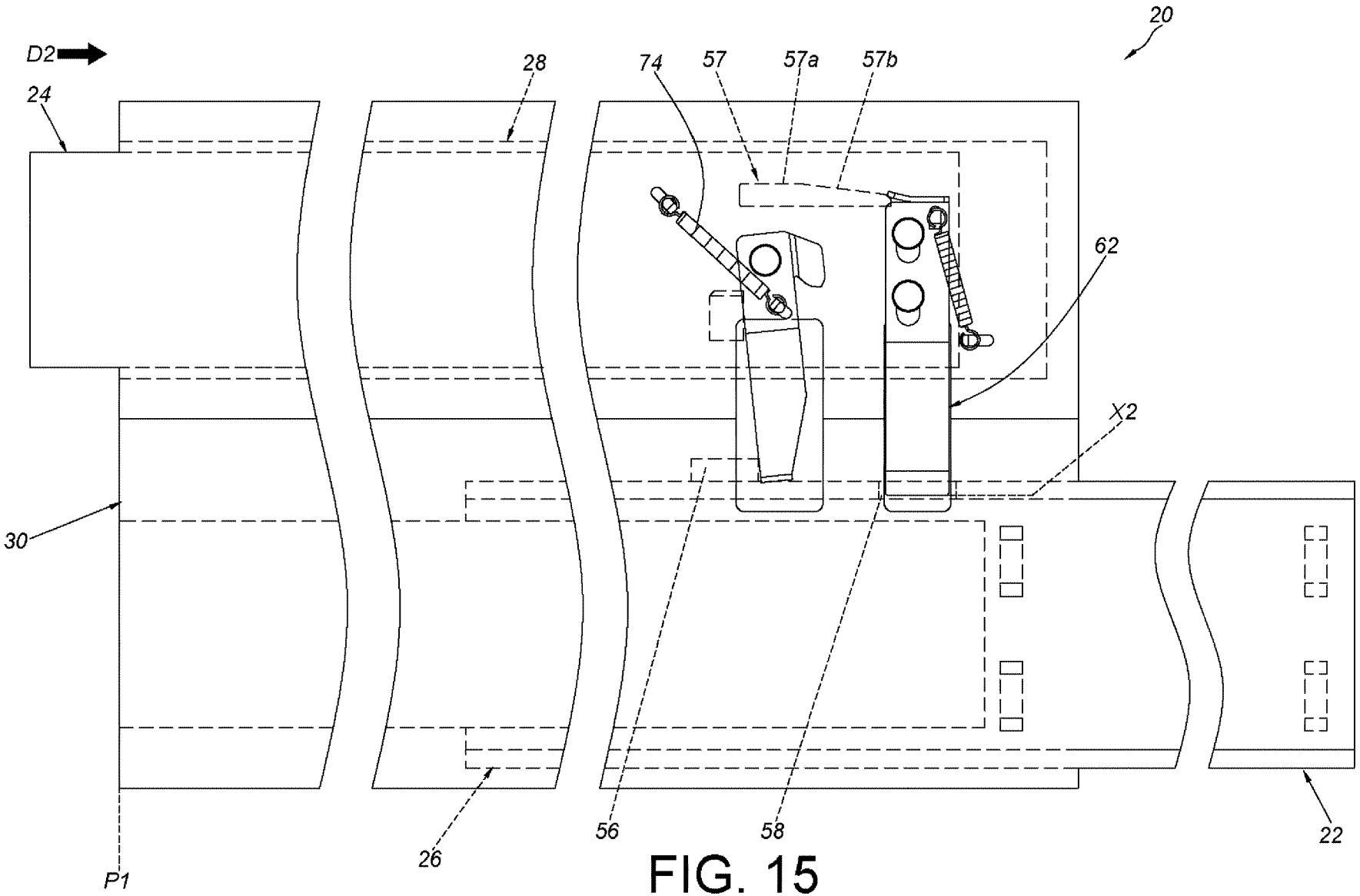
FIG. 15 is a diagram illustrating the second rail of the slide rail assembly is moved relative to the mounting member along a retracting direction according to the embodiment of the present invention.
Figure 16:
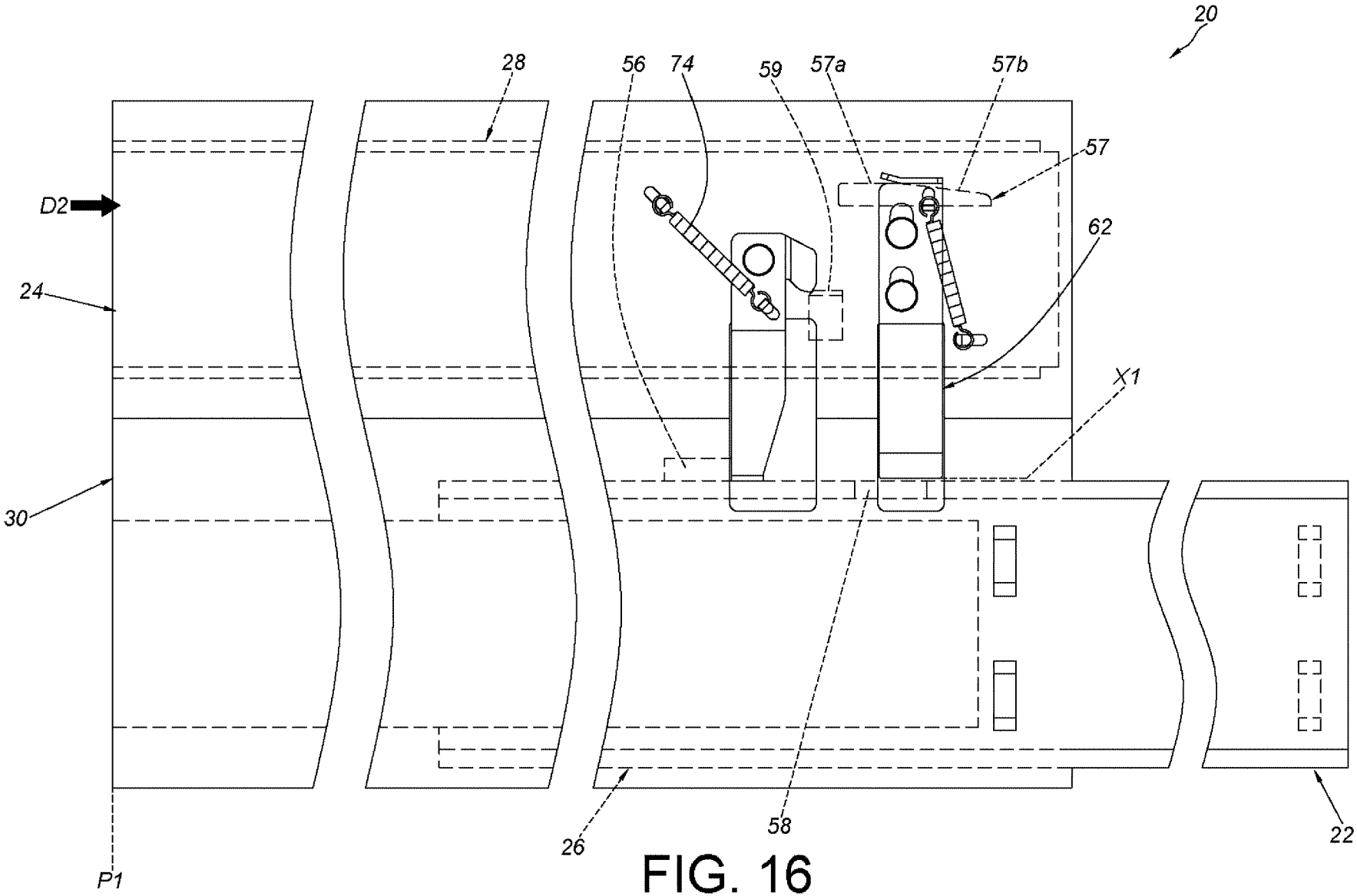
FIG. 16 is a diagram illustrating the second rail of the slide rail assembly is further moved relative to the mounting member along a retracting direction according to the embodiment of the present invention.

As shown in FIG. 15 and FIG. 16, when the second rail 24 is moved relative to the fourth rail 28 to a predetermined retracted position along the retracting direction D2, the second rail 24 is able to drive the positioning member 62 through the guiding section 57*b* of the function portion 57, such that the positioning member 62 is moved from the engaged position X2 to the disengaged position X1 and is no longer engaged with the engaging feature 58 of the first rail 22. As such, the second rail 24 and the mounting member 30 are able to be moved along the retracting direction D2 until the slide rail assembly 20 is in the retracted state. It is noticed that when the second rail 24 is located to the retracted position R again, the synchronizing member 60 is back in an initial state in response to the elastic force released from the first elastic member 74 (as shown in FIG. 5).

Figure 17:
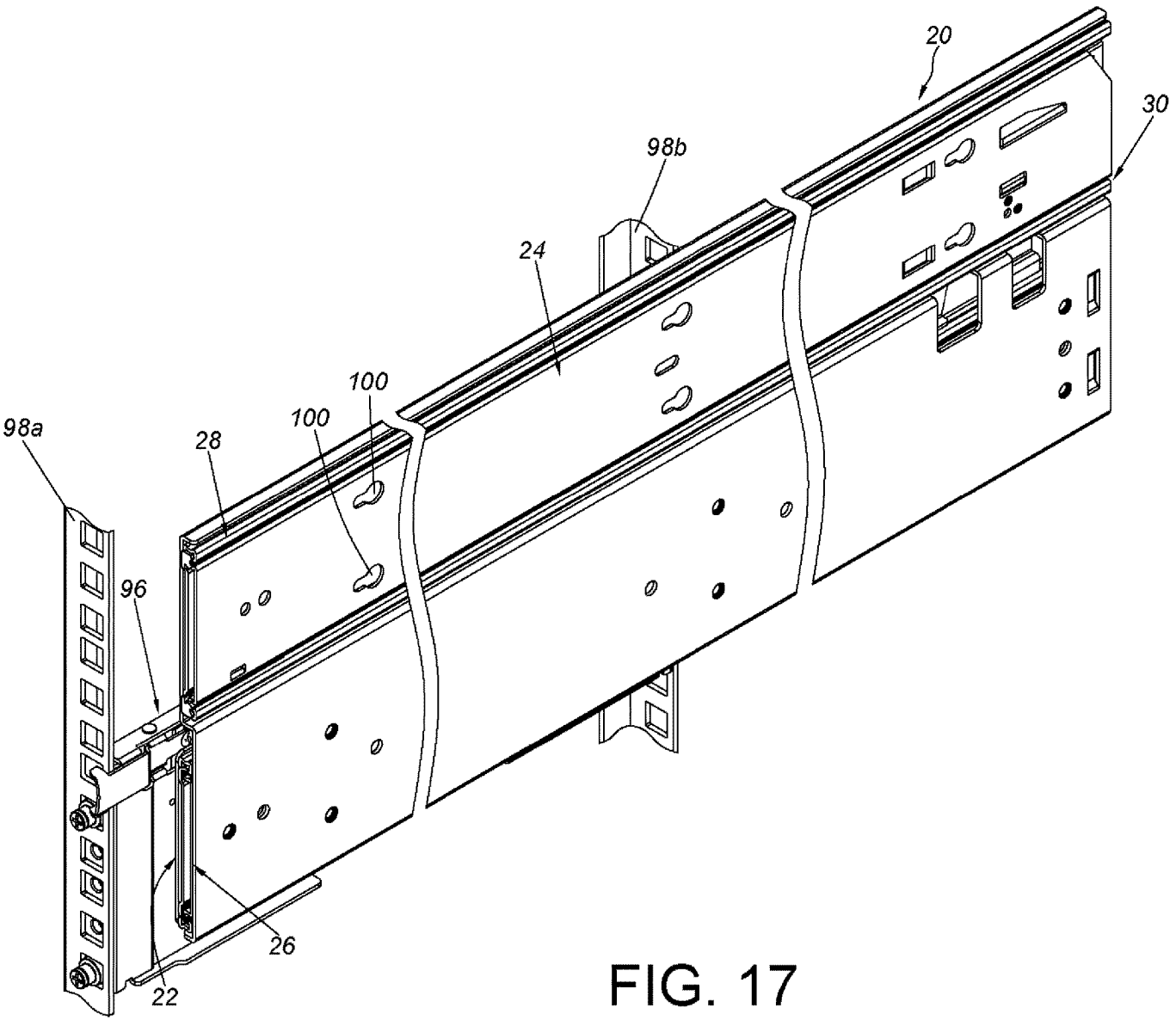
FIG. 17 is a diagram illustrating the slide rail assembly applied to a rack according to the embodiment of the present invention.

As shown in FIG. 17, the slide rail assembly 20 is able to be applied on a rack. For example, the front portion 22*a* and the rear portion 22*b* of the first rail 22 are able to be respectively mounted on a first post 98*a* and a second post 98*b* of a rack through a bracket device 96 (a bracket device 84 mounted on the rear portion 22*b* of the first rail 22 is not shown due to the angle of view). Wherein, the second rail 24 has a plurality of mounting features 100 configured to mount a carried object (e.g. an electronic apparatus) or a drawer.

Compared to the prior art, the slide rail assembly 20 of the present invention has advantages over the prior art by the following perspectives:

1. The slide rail assembly 20 comprises a first rail 22, a second rail 24, a third rail 26 and a fourth rail 28 and a mounting member 30. Wherein, the third rail 26 and the fourth rail 28 are respectively connected (such as be fixedly connected) to the mounting member 30. The mounting member 30, the third rail 26 and the fourth rail 28 are able to be regarded as a one-piece member. The third rail 26 is able to be longitudinally moved relative to the first rail 22, and the second rail 24 is able to be longitudinally moved relative to the fourth rail 28.

2. When the second rail 24 is moved from a retracted position R along an extending direction D1, the mounting member 30 and the second rail 24 are able to be synchronously moved through a synchronizing member 60. When the mounting member 30 and the second rail 24 are moved to the predetermined position, the synchronizing member 60 is driven by a disengaging feature 56 of the first rail 22, such that the second rail 24 and the mounting member 30 are no longer synchronously moved.

3. When the mounting member 30 and the second rail 24 are no longer synchronously moved, the mounting member 30 is able to be engaged with an engaging feature 58 of the first rail 22 through a positioning member 62, such that the mounting member 30 (and the third rail 26 and the fourth rail 28) is able to be hold to be located at extended position P1 relative to the first rail 22. Wherein, the second rail 24 is able to be further moved relative to the mounting member 30 to an open position P2.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly, comprising:

a first rail comprising a disengaging feature;

a second rail, wherein an abutting feature is arranged on the second rail;

a mounting member;

a third rail and a fourth rail respectively connected to a first side of the mounting member and a second side of the mounting member; and a synchronizing member arranged on the mounting member;

wherein the third rail is longitudinally movable relative to the first rail, and the second rail is longitudinally movable relative to the fourth rail;

wherein when the second rail is moved from a retracted position along an extending direction, the abutting feature of the second rail abuts against the synchronizing member, such that the mounting member and the second rail are synchronously moved, when the mounting member and the second rail are synchronously moved to a predetermined position, the synchronizing member is driven by the disengaging feature of the first rail to be disengaged from the abutting feature, such that the second rail and the mounting member are no longer synchronously moved;

wherein the first rail further comprises an engaging feature, the slide rail assembly further comprises a positioning member able to be located at a disengaging position or an engaging position relative to the mounting member, when the mounting member and the second rail are no longer synchronously moved, the mounting member is engaged with the engaging feature of the first rail through the positioning member being moved from the disengaging position to the engaging position.

2. The slide rail assembly of claim 1, wherein the synchronizing member is pivoted to the mounting member by a shaft member, the synchronizing member has a first contact portion and a second contact portion, the first contact portion is configured to cooperate with the abutting feature of the second rail, the second contact portion is configured to cooperate with the disengaging feature of the first rail.

3. The slide rail assembly of claim 2, wherein the mounting member comprises a first opening corresponding to the first rail, the second contact portion of the synchronizing member passes through the first opening.

4. The slide rail assembly of claim 2, further comprising a first elastic member configured to provide an elastic force to the synchronizing member.

5. The slide rail assembly of claim 1, wherein the positioning member is movably mounted on the mounting member, the mounting member has a second opening corresponding to the first rail, a part of the positioning member passes through the second opening to be engaged with the engaging feature of the first rail.

6. The slide rail assembly of claim 1, further comprising a second elastic member configured to provide an elastic force to the positioning member.

7. The slide rail assembly of claim 1, wherein the first rail and the second rail are respectively oriented parallel to upper and lower parts of the mounting member.

8. The slide rail assembly of claim 1, wherein the mounting member comprises a first portion and a second portion, the fourth rail is fixedly connected to the first portion, and the third rail is fixedly connected to the second portion.

9. The slide rail assembly of claim 8, wherein the mounting member further comprises a third portion, the first portion and the second portion are substantially perpendicular to the third portion and extended along different directions.

10. The slide rail assembly of claim 9, wherein the first side and the second side of the mounting member are two opposite sides.

11. The slide rail assembly of claim 9, wherein the first rail comprises a first wall, a second wall and a side wall connected between the first wall and the second wall of the first rail, a first passage is defined by the first wall, the second wall and the side wall of the first rail, the third rail is movable relative to the first rail through the first passage.

12. The slide rail assembly of claim 11, wherein the third rail comprises a first wall, a second wall and a side wall connected between the first wall and the second wall of the third rail, the side wall of the third rail is connected to the second portion of the mounting member, the first and second walls of the third rail are located in the first passage.

13. The slide rail assembly of claim 12, further comprising a first sliding auxiliary device movably mounted between the first rail and the third rail, wherein the first sliding auxiliary device comprises a plurality of sliding auxiliary members configured to support the first wall of the first rail and the first wall of the third rail and configured to support the second wall of the first rail and the second wall of the third rail.

14. The slide rail assembly of claim 11, wherein the first wall of the first rail has a first section and a second section bent relative to the first section, and the second wall of the first rail has a third section and a fourth section bent relative to the third section.

15. The slide rail assembly of claim 13, wherein the fourth rail comprises a first wall, a second wall and a side wall connected between the first wall and the second wall of the fourth rail, the side wall of the fourth rail is connected to the first portion of the mounting member, a second passage is defined by the first wall, the second wall and the side wall of the fourth rail, the second rail is movable relative to the fourth rail through the second passage.

16. The slide rail assembly of claim 15, wherein the second rail comprises a first wall, a second wall and a side wall connected between the first wall and the second wall of the second rail, the first and second walls of the second rail are located in the second passage.

17. The slide rail assembly of claim 16, further comprising a second sliding auxiliary device movably mounted between the fourth rail and the second rail, wherein the second sliding auxiliary device comprises a plurality of sliding auxiliary members configured to support the first wall of the fourth rail and the first wall of the second rail and configured to support the second wall of the fourth rail and the second wall of the second rail.

18. The slide rail assembly of claim 1, wherein the fourth rail comprises a front portion and a blocking base located adjacent to the front portion, and a first blocking member and a second blocking member are both movably mounted on the second rail, when the second rail is moved relative to the fourth rail along the extending direction to an open position, the first blocking member and the second blocking member are located at two sides of the blocking base at a blocking position, such that the first blocking member and the second blocking member are blocked by the blocking portion of the blocking base, in order to prevent the second rail from being moved along the extending direction or a retracting direction.

19. The slide rail assembly of claim 18, wherein when the first blocking member is not located at the blocking position, the second rail is movable from the open position along the retracting direction, when the second rail is moved to a predetermined retracted position, the positioning member is driven by the second rail to move from the engaging position, such that the positioning member is no longer engaged with the engaging feature of the first rail.

* * * * *